US007637796B2

(12) United States Patent
Hippely

(10) Patent No.: US 7,637,796 B2
(45) Date of Patent: Dec. 29, 2009

(54) PLAYSET WITH OBSTACLES AND LANE SWITCHES

(75) Inventor: Keith Hippely, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 480 days.

(21) Appl. No.: 11/594,018

(22) Filed: Nov. 6, 2006

(65) Prior Publication Data

US 2007/0149090 A1 Jun. 28, 2007

Related U.S. Application Data

(60) Provisional application No. 60/733,558, filed on Nov. 4, 2005.

(51) Int. Cl.
*A63H 29/00* (2006.01)

(52) U.S. Cl. ..... 446/429; 446/332; 446/431; 446/444; 463/59; 463/63

(58) Field of Classification Search ..... 446/332, 446/429, 431, 433, 441, 445, 465, 430, 444, 446/446; 463/58, 59, 63
See application file for complete search history.

(56) References Cited

U.S. PATENT DOCUMENTS 2,161,314 A * 6/1939 Randall et al. ..... 104/60
3,315,632 A * 4/1967 Hyden ..... 116/223
3,377,958 A 4/1968 Bax et al.
3,496,674 A * 2/1970 Cooper ..... 446/446
3,566,798 A * 3/1971 Peitzman ..... 104/44
3,572,711 A 3/1971 Conklin et al.
3,641,704 A * 2/1972 Sims et al. ..... 446/429
3,712,541 A * 1/1973 Merino et al. ..... 238/10 E
3,712,615 A * 1/1973 Staats et al. ..... 463/59
3,860,237 A * 1/1975 Cooper et al. ..... 463/63
3,970,309 A * 7/1976 Sato ..... 463/59
4,094,089 A 6/1978 Sano
4,147,351 A * 4/1979 Saito ..... 463/63
4,227,693 A * 10/1980 Moe et al. ..... 463/69
4,295,649 A 10/1981 Cooper
4,330,127 A * 5/1982 Brand et al. ..... 463/59
4,355,807 A 10/1982 Prehodka
4,364,566 A 12/1982 Neuhierl
4,382,599 A * 5/1983 Tilbor ..... 463/59
4,383,688 A * 5/1983 Prehodka ..... 238/10 F
4,401,305 A * 8/1983 Sano ..... 463/59
4,415,157 A 11/1983 Lahr
4,498,398 A * 2/1985 Vallee ..... 104/44

(Continued)

OTHER PUBLICATIONS

An International Search Report from International Patent Application No. PCT/US06/43398, mailed Aug. 1, 2007.

*Primary Examiner*—Gene Kim
*Assistant Examiner*—Scott Young
(74) *Attorney, Agent, or Firm*—Kolisch Hartwell, P.C.

(57) ABSTRACT

A playset for use with a toy vehicle including an elongate track defining at least one travel path. In some examples, the playset includes a switching mechanism for switching a toy vehicle between different travel paths. In some examples, the playset includes an obstacle mechanism for selectively deploying an obstacle in at least one travel path. In some examples, the playset includes indicator mechanisms, including an active indicator mechanism and a passive indicator mechanism.

18 Claims, 7 Drawing Sheets

U.S. PATENT DOCUMENTS

| | | | | |
|---|---|---|---|---|
| 4,513,966 | A | 4/1985 | Mucaro et al. | |
| 4,715,843 | A | 12/1987 | Ostendorff et al. | |
| 5,038,685 | A | 8/1991 | Yoneda et al. | |
| 5,125,010 | A | 6/1992 | Lee et al. | |
| 5,174,569 | A | 12/1992 | Ngai | |
| 5,299,969 | A * | 4/1994 | Zaruba | 446/429 |
| 5,542,668 | A | 8/1996 | Casale et al. | |
| 5,767,655 | A * | 6/1998 | Ostendorff et al. | 320/107 |
| 6,089,951 | A * | 7/2000 | Ostendorff | 446/429 |
| 6,109,186 | A | 8/2000 | Smith et al. | |
| 6,179,686 | B1 | 1/2001 | Ogawa et al. | |
| 6,241,573 | B1 * | 6/2001 | Ostendorff et al. | 446/444 |
| 6,517,007 | B2 * | 2/2003 | Kong | 238/10 F |
| 6,575,809 | B2 | 6/2003 | Ogawa et al. | |
| 6,676,480 | B2 | 1/2004 | Sheltman | |
| 6,695,675 | B1 * | 2/2004 | Ngan | 446/429 |
| 6,793,554 | B1 * | 9/2004 | Newbold | 446/429 |
| 6,799,530 | B1 * | 10/2004 | Heichelbech | 116/174 |
| 6,951,497 | B1 | 10/2005 | Ngan | |
| 2005/0148281 | A1 | 7/2005 | Sanchez-Castro et al. | |
| 2005/0191940 | A1 | 9/2005 | Sheltman et al. | |

* cited by examiner

PLAYSET WITH OBSTACLES AND LANE SWITCHES

RELATED APPLICATION

This application claims priority under 35 U.S.C. § 119(e) to U.S. Provisional Application No. 60/733,558 filed on Nov. 4, 2005, the disclosure of which is incorporated herein by reference for all purposes.

BACKGROUND

Playsets and accompanying toy vehicles are a source of entertainment to persons using them. Playsets can include track sections and apparatuses that guide the motion of one or more toy vehicles. Various types of motion are possible on a playset including linear and rotational motion. Different vehicle propulsion means can be used, such as storing energy for propulsion in the vehicle, drawing energy for propulsion from an external power source, or manually propelling the vehicle. Toy vehicles may maintain contact with a playset due to gravity, magnetic forces, and/or mechanical attachment of the vehicle to the playset.

The following patents and patent application publications disclose examples of toy playsets, and are incorporated in their entirety herein by reference for all purposes: U.S. Pat. Nos. 3,315,632; 3,377,958, 3,496,674, 3,572,711, 3,712,615, 3,970,309, 4,094,089, 4,251,949, 4,295,649, 4,330,127, 4,364,566, 4,383,688, 4,415,157, 4,513,966, 4,715,843, 5,038,685, 5,125,010, 5,174,569, 5,299,969, 5,542,668, 5,767,655, 6,089,951, 6,109,186, 6,179,686, 6,575,809, 6,676,480, 6,951,497, and U.S. Publication No. 2005/0148281 and 2005/0191940.

SUMMARY

The present disclosure is directed to a playset for use with a toy vehicle, the playset including an elongate track defining at least one travel path. In some examples, the playset includes a switching mechanism for switching a toy vehicle between different travel paths. In some examples, the playset includes an obstacle mechanism for selectively deploying an obstacle in at least one travel path. In some examples, the playset includes an indicator mechanism, such as an active indicator mechanism and a passive indicator mechanism.

DETAILED DESCRIPTION

Figure 1:
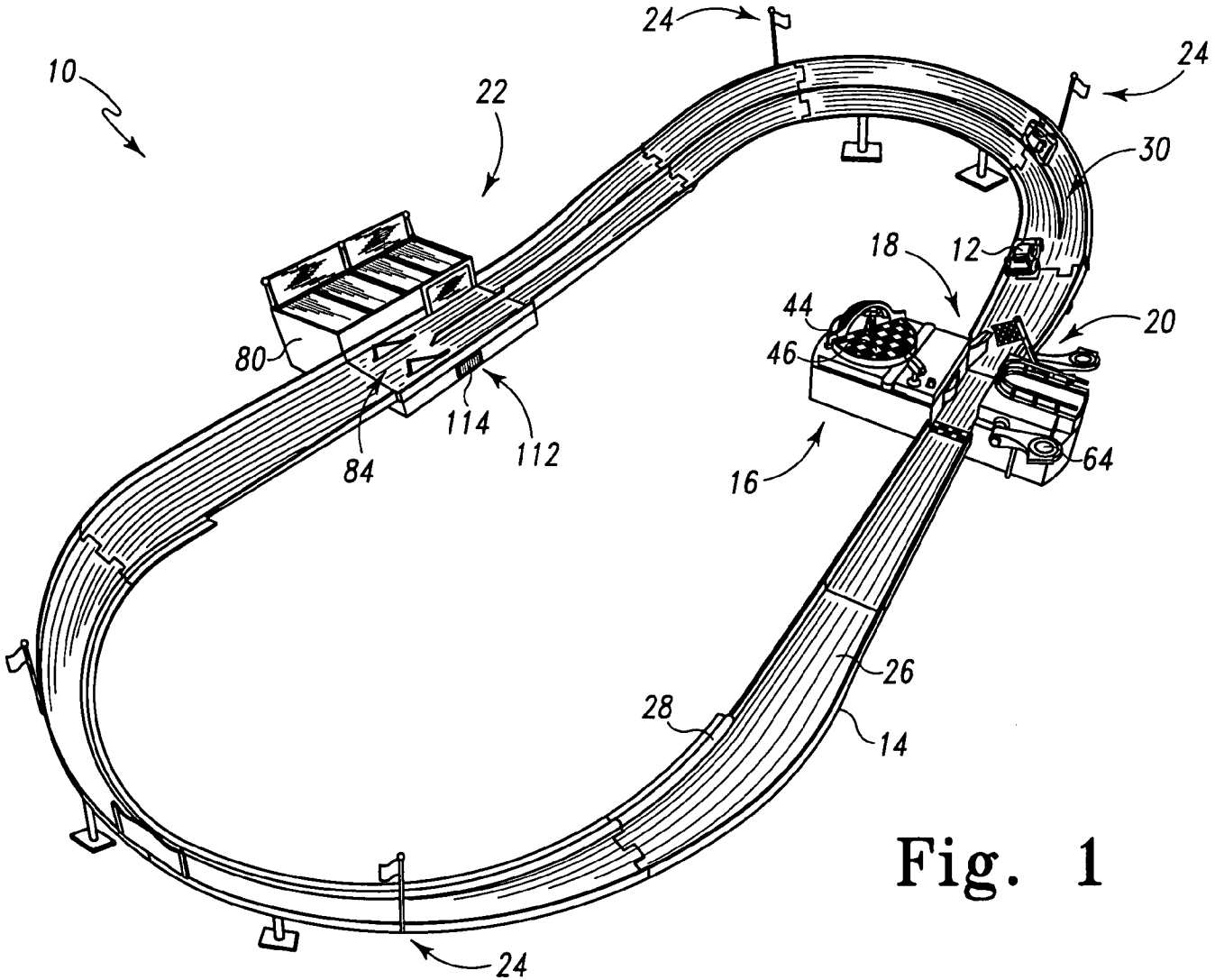
FIG. 1 is a perspective view of a playset for use with a toy vehicle.

An exemplary and non-exclusive example of playset 10 for use with a toy vehicle 12 is shown in FIG. 1. Playset 10 may include an elongate track 14, a booster mechanism 16, a switching mechanism 18, an active indicator mechanism 20, an obstacle mechanism 22, and a passive indicator mechanism 24. Toy vehicle 12 may travel along track 14 and interface with the aforementioned mechanisms.

An elongate track 14 may provide a surface 26 on which toy vehicle 12 may move about playset 10. Elongate track 14 may also include guide rails 28 bounding surface 26 to maintain toy vehicle 12 on the track 14. Single lane and multiple lane elongate track sections may be used to define various travel paths 30 that toy vehicle 12 may take. Elongate track 14 may extend various distances and form various shapes, such as a circle, a figure-eight, or an oval. Elongate track 14 may comprise a combination of level and banked sections.

Figure 2:
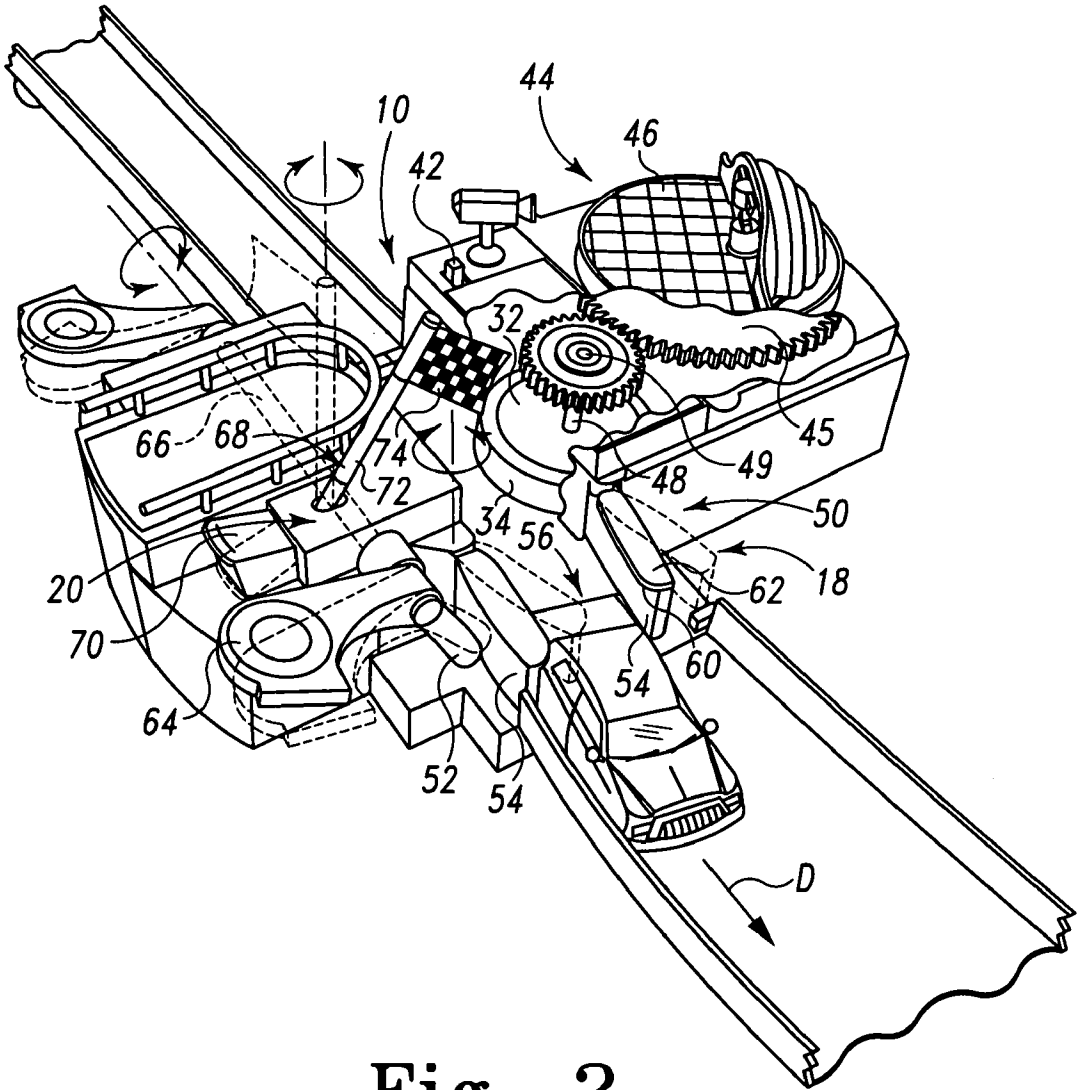
FIG. 2 is a perspective view of a booster mechanism, a switching mechanism, and an active indicator mechanism, each of which may optionally be used in the playset of FIG. 1.

To propel vehicles around track 14, booster mechanism 16 may be provided. Booster mechanism 16 may be positioned at any of various positions along the elongate track. As shown in FIGS. 1 and 2, booster mechanism 16 may comprise a pair of spaced apart, rotating booster wheels 32 disposed on opposite sides of travel path 30. Booster wheels 32 may operate in conjunction to engage toy vehicle 12 from both sides and impart energy and acceleration to the vehicle in a forward direction D. Booster mechanism 16 may also comprise a flywheel (not pictured) to store rotational energy.

Booster wheels 32 may employ disc-shaped members formed of a resilient material to provide frictional engagement with the passing toy vehicle 12 to an extent sufficient to allow the rotating booster wheel 32 to accelerate toy vehicle 12. Booster wheels 32 may be selected to resiliently deform to accommodate a variety of differently sized and shaped toy vehicles 12. Frictional engagement of toy vehicle 12 may be facilitated by selecting a material for an engagement surface 34 of booster wheel 32 that has a desired coefficient of friction.

In some embodiments, booster wheel 32 rotation may occur by human power. Booster mechanism 16 may include an actuator (not pictured) that a user may actuate to rotate the booster wheels 32. Various actuation methods are contemplated, including depressing, rotating, sliding, or pulling the actuator.

Figure 3:
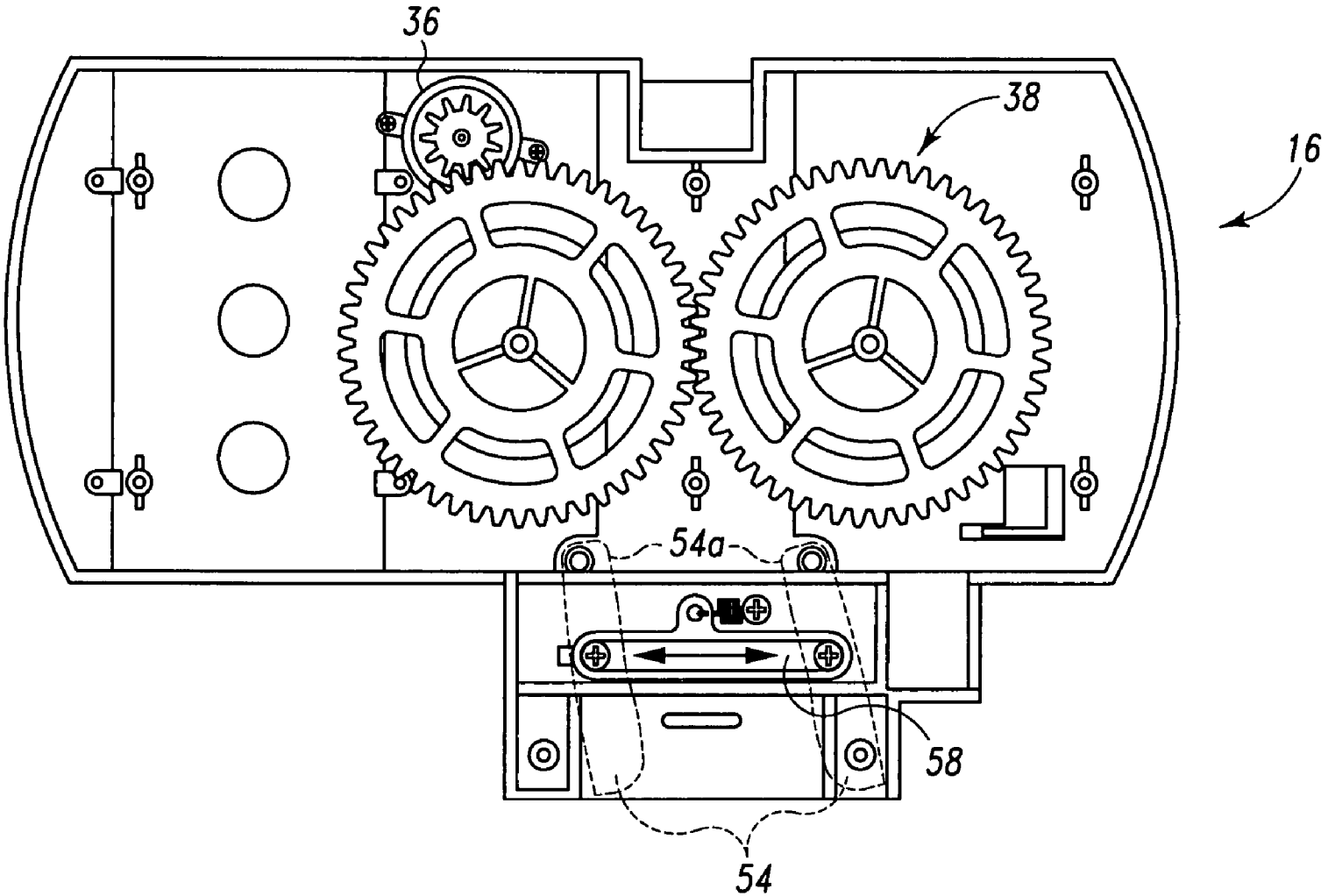
FIG. 3 is a bottom view of the switching mechanism shown in FIG. 2 with a bottom cover removed.

In one example, booster wheel 32 rotation occurs by electrical power. As shown in FIG. 3, booster mechanism 16 may include a motor 36 connected to booster wheels 32 through booster gears 38. Motor 36 may be powered by a power supply. The power supply may be an external power source, such as an electrical wall outlet, or it may be an electricity storage means, such as a battery. Booster wheel 32 rotation may be turned completely on and off by closing and opening a switch 42, respectively. Further, the speed in which booster wheels 32 rotate may be controlled by varying the current or voltage supplied to the motor.

A display platform 44 may be connected to booster mechanism 16 and rotate while supporting toy vehicle 12 thereon. Display platform 44 may include a display platform gear 45 and a vehicle support surface 46 on which toy vehicle 12 may rest. Display platform 44 may mount to display platform gear and rotate concurrently with rotation of display platform gear 45.

An extension shaft 48 and an extension gear 49 may couple vehicle display platform gear 45 to booster gears 38. Extension shaft 48 may extend from booster gears 38 such that it terminates substantially in the same plane in which display platform gear 45 lies. Further, extension shaft 48 may transfer motion from booster gears 38 to extension gear 49, such as rotational motion. Extension gear 49 may engage display platform gear 45 and cause it to rotate.

Switching mechanism 18 may operate to direct toy vehicle 12 towards different travel paths 30. Switching mechanism 18 may be provided in a position on the travel path in direction D forward of booster mechanism 16. As can be seen in FIG. 2, switching mechanism 18 may include a chute 50 and an actuator 52.

Chute 50 may include two, spaced apart members or sidewalls 54 that cooperatively direct toy vehicle 12 towards direction portions of track 14 by forming a channel 56. Sidewalls 54 may be spaced apart a distance slightly wider than the width of toy vehicle 12. Sidewalls 54 may each be pivotally mounted at ends 54A and pivot between a first position and a second position when actuated by actuator 52. As shown in FIG. 3, sidewalls 54 may be coupled together by a slidably mounted coupling member 58 that is attached pivotingly to sidewalls 54 at positions spaced from ends 54A.

A lip 60 may be provided along an upper edge or top 62 of each sidewall 54 and project into channel 56 over track 14. Lip 60 may help to maintain toy vehicle 12 in a substantially horizontal travel path after it passes through booster mechanism 16. Booster mechanism 16 may occasionally cause the front end of toy vehicle 12 to lift off of surface 26 and lip 60 may direct it back toward surface 26.

Actuator 52 may include a handle 64 for use by a user to move sidewalls 54 between the first and second positions. In the non-exclusive example shown in FIG. 2, actuator 52 includes two handles 64 spaced apart and connected by a linking shaft 66. In the example with two handles 64, two users may concurrently participate in actuating sidewalls 54. A single handle, more than two handles, or no handle may be provided in alternative examples.

Playset 10 may include an active indicator mechanism 20 that a user may selectively activate. Active indicator mechanism 20 may include a pivotally mounted indicator flag 68 and an activator 70. Indicator flag 68 may pivot between a rest position (shown in solid lines in FIG. 2) and an activated or upright position (shown in dashed lines in FIG. 2). Indicator flag 68 may be biased into the rest position by a biasing member, such as a spring (not shown).

Indicator flag 68 may include an indicator shaft 72 and a flag 74 slidably mounted to indicator shaft 72. Flag 74 may loosely surround indicator shaft 72 and freely slide around it when indicator 68 pivots between the rest position and the activated position. Flag 74 freely sliding around indicator shaft 72 is depicted in FIG. 2 by flag 74 in solid lines juxtaposed with flag 74 in dotted lines.

As shown in FIG. 3, engaging activator 70 may pivot indicator flag 68 between the rest and activated positions. Activator 70 may be a button, a lever, a slider, or a dial in addition to other common activators. In the non-exclusive example shown in FIG. 3, a user may press activator 70 to pivot indicator flag 68, for example, to indicate when it is the final lap.

Vehicle 12 traveling along track 14 may encounter obstacle mechanism 22 configured to selectively deploy an obstacle 76 in an intermittently obstructed travel path 77. Obstacle mechanism 22 may deploy obstacle 76 into all travel paths or into a subset of the total number of travel paths. For example, the obstacle mechanism depicted in FIG. 4 includes a single potentially obstructed travel path 77 although there are two travel paths. Deploying obstacle 76 into a subset of the total number of travel paths provides for one or more unobstructed travel paths 78, which may impart an element of skill into use of playset 10. For example, a user may seek to direct vehicle 12 into unobstructed travel path 78 through operation of switching mechanism 18.

Figure 4:
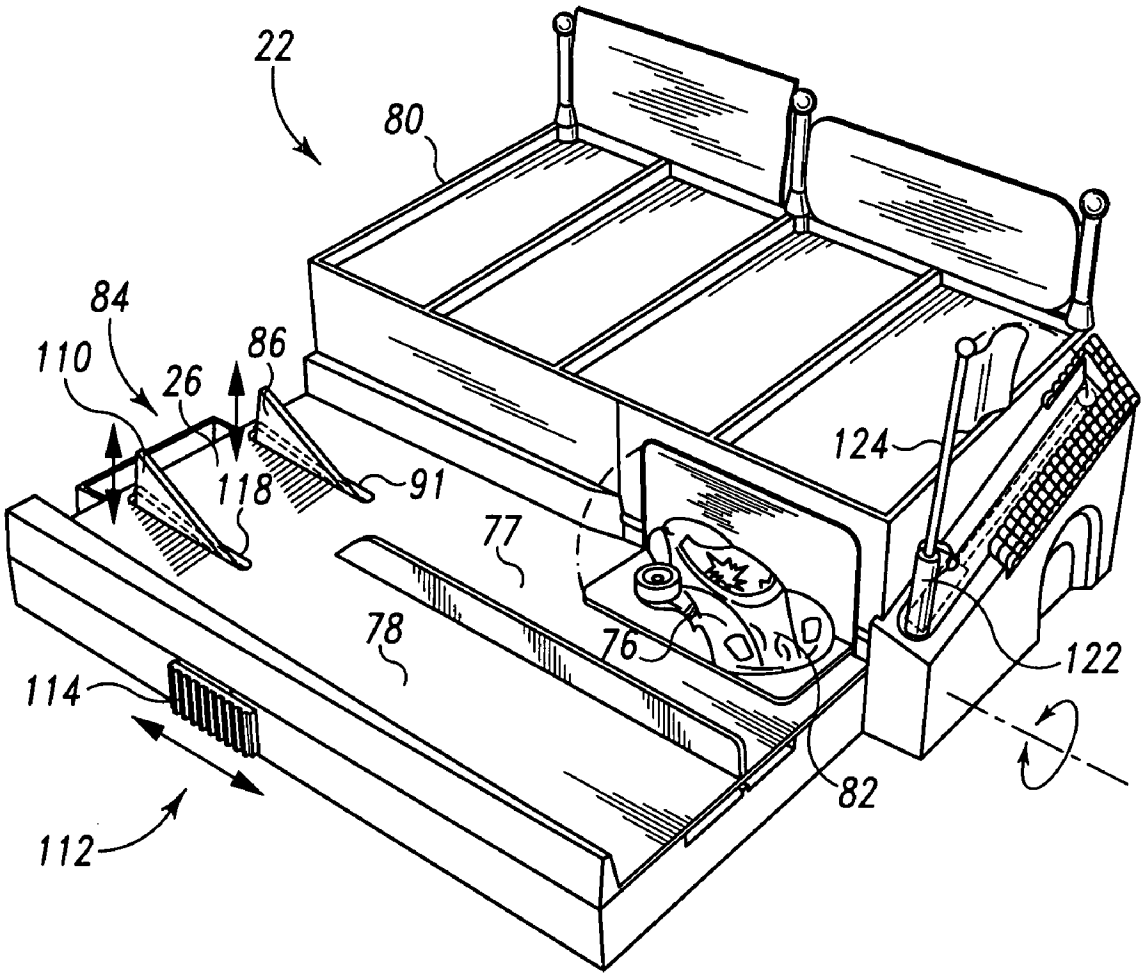
FIG. 4 is a perspective view of an obstacle mechanism that may optionally be used with the playset of FIG. 1.
Figure 6:
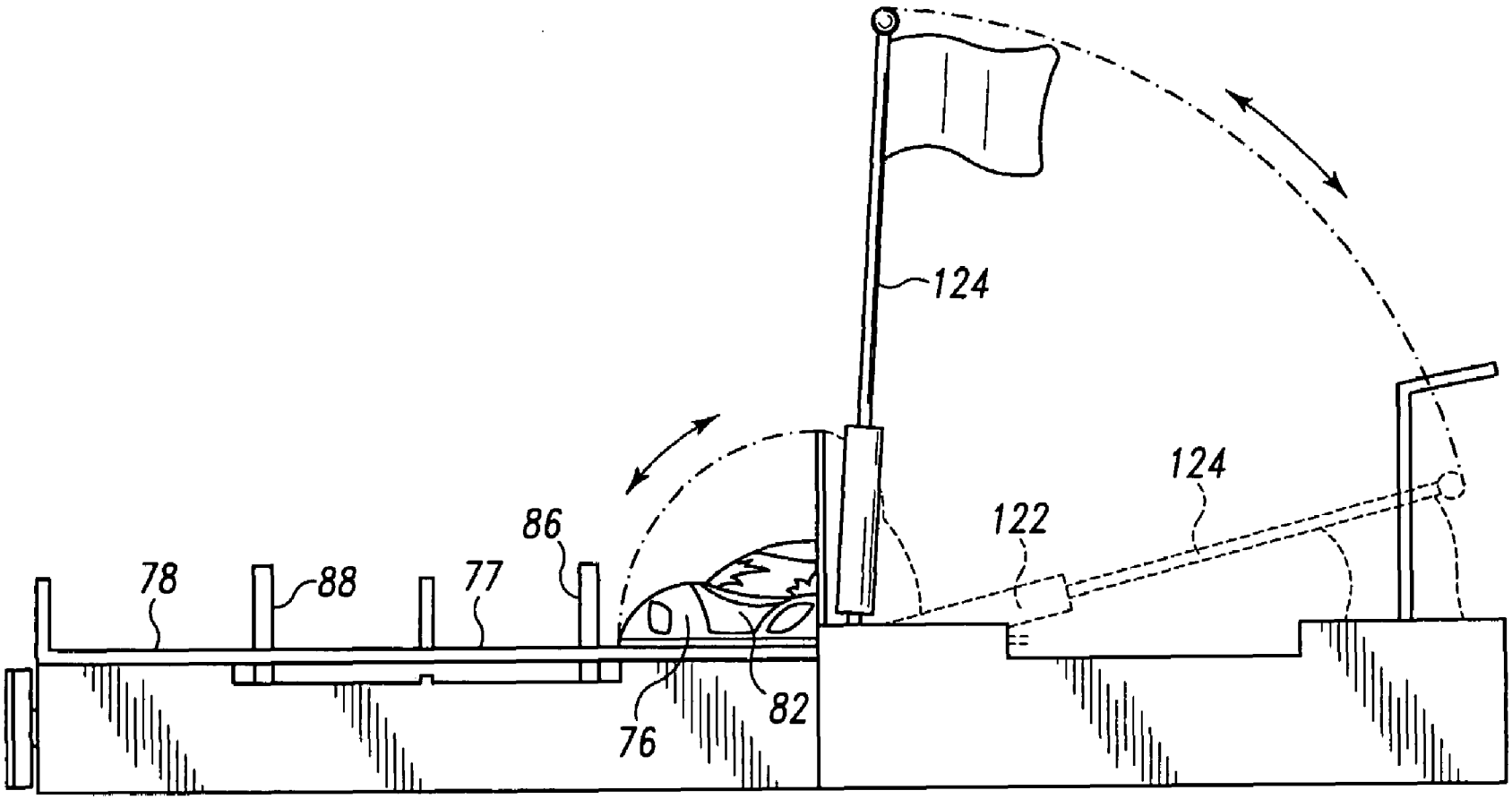
FIG. 6 is a side view of an obstacle indicator mechanism that may optionally be included with the playset of FIG. 1.

As shown in FIGS. 4 and 6, obstacle 76 may pivot between a deployed position and a stowed or recessed position. In the deployed position, obstacle 76 may obstruct vehicle 12 when vehicle 12 travels in travel path 77 when obstacle 76 is in the deployed position. In the stowed position, obstacle 76 may reside within an obstacle mechanism compartment or housing 80 and may leave intermittently obstructed travel path 77 unobstructed. Obstacle 76 may present vehicle 12 with an inclined surface 82 on which vehicle 12 may travel causing it to potentially launch into the air. In some examples, obstacle 76 presents vehicle 12 with a substantially vertical surface, which may cause vehicle 12 to come to an abrupt stop when it collides with obstacle 76.

Deployment of obstacle 76 may occur after a set number of activations of a counter mechanism 84. Counter mechanism 84 may include a first trigger 86 fixedly secured to a counter mechanism shaft 88 having a transmission gear 90 fixedly attached thereto. First trigger 86 may be positioned to pivot through an aperture 91 into surface 26 of track 14 when it is contacted by vehicle 12. Pivoting first trigger 86 may in turn cause counter mechanism shaft 88 to rotate. Rotational energy may be transferred throughout counter mechanism 84 and to obstacle mechanism 22 by intermeshing gears as further described below.

Counter mechanism 84 may optionally include a change gear 92 meshed with transmission gear 90 to change the gear ratio of counter mechanism 84. Meshing transmission gear 90 with change gear 92 may cause change gear 92 to rotate as transmission gear 90 rotates and decrease the number of times first trigger 86 must be engaged to cause obstacle 76 to deploy. Change gear 92 may be mounted to a common shaft with a one-way mechanism 93 configured to limit rotation of the common shaft to a preferred direction.

Figure 5:
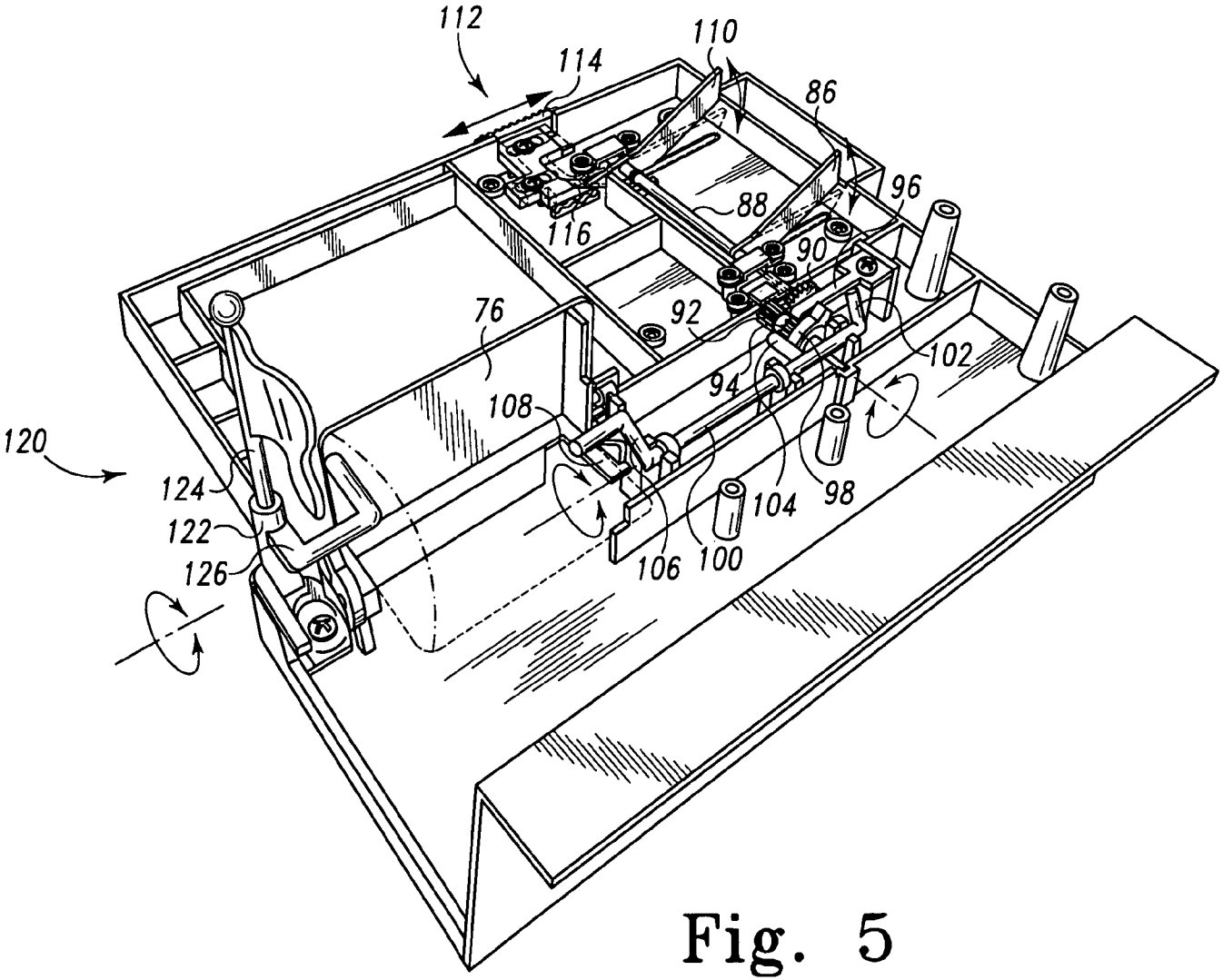
FIG. 5 is a perspective view of the obstacle mechanism of FIG. 4 with top covers removed.

One-way mechanism 93 may include a one-way gear 94 and a one-way member 96. As shown in FIG. 5, one-way gear 94 may be a spur gear with teeth configured to engage one-way member 96. One-way member 96 may be made of a resilient material and may be fixedly secured on a first end and rest on the teeth of one-way gear 94 near a second end. The second end of one-way member 96 may deflect upwards as one-way gear 94 rotates in the permissible direction. The resiliency of one-way member 96 may cause the second end to slide down a backside of each tooth as it rotates past the second end, thus preventing reverse rotation of one-way gear 94. In this manner, one-way mechanism may permit rotation of one-way gear 94 in one direction and restrict rotation in the other direction.

As shown in FIG. 5, change gear 92 may also be mounted to a common shaft with a cam 98 such that cam 98 rotates as change gear 92 rotates. Cam 98 may engage a crankshaft 100 as it rotates and cause crankshaft 100 to move. Crankshaft 100 may link counter mechanism 84 with obstacle mechanism 22 as described more fully below.

In the example shown in FIGS. 4-6, crankshaft 100 includes a first projection 102, a second projection 104, and a third projection 106. Cam 98 may engage first projection 102 and second projection 104 as it rotates in turn with change gear 92. Cam 98 engaging each of first projection 102 and second projection 104 may cause crankshaft 100 to move, such as to rotate as shown in FIG. 5. Rotation of crankshaft 100 typically causes third projection 106 to rotate.

Rotation of third projection 106 may bring it into contact with an interface member 108 of obstacle mechanism 22 as shown in FIG. 5. Interface member 108 may project from obstacle 76 which is pivotally mounted to obstacle mechanism housing 80. In the example shown in FIG. 5, rotation of third projection 106 causes it to engage interface member 108 and pivot obstacle 76 between the deployed position and the stowed position. Thus, in some examples the relative sizing between the gearing associated with the counter mechanism 84 and the obstacle mechanism 22 may determine how many times first trigger 86 must be depressed to pivot obstacle 76 between the deployed and stowed positions.

In the example shown in FIGS. 4-6, counter mechanism 84 includes first trigger 86 and a second trigger 110 However, more or fewer triggers 86 may be provided, such as a number of triggers 86 corresponding to an available number of travel paths. In the example shown in FIGS. 4-6, first trigger 86 is disposed in intermittently obstructed travel path 77 and second trigger 110 is disposed in unobstructed travel path 78. Additionally or alternatively, different types of triggers 86, such as motion sensors, magnetic sensors, or pressure sensors may be used.

Counter mechanism 84 may include a lock mechanism 112 for locking counter mechanism 84 in a non-counting position where first trigger 86 and second trigger 110 are retracted into first aperture 91 and a second aperture 118, respectively of surface 26. Lock mechanism 112 may include a selector tab 114 linked to a wedge 116. Selector tab 114 may be slidably mounted and allow a user to engage or disengage lock mechanism 112 by sliding it between a lock position and an unlock position. Sliding selector tab 114 into the lock position may slide wedge 116 under second trigger 110 and cause it and first trigger 86 to retract below surface 26 of track 14 in a non-counting position where they are not contacted by toy vehicles traveling on track 14.

In some examples, playset 10 may include an obstacle flag assembly 120 configured to pivot into a warning position when obstacle 76 is deployed. Obstacle flag assembly 120 may include a pivotally mounted sleeve 122, an obstacle flag 124 rotatably mounted within sleeve 122, and a linking member 126 linking sleeve with obstacle 76. Linking sleeve 122 to obstacle 76 with linking member 126 typically causes sleeve 122 and obstacle flag 124 to pivot into an upright warning position shown in FIG. 5 when obstacle 76 is in the deployed position. When obstacle 76 is in the stowed position, linking member 126 typically causes sleeve 122 and obstacle flag 124 to pivot into a non-warning position shown in dotted lines in FIGS. 4 and 6.

Figure 7:
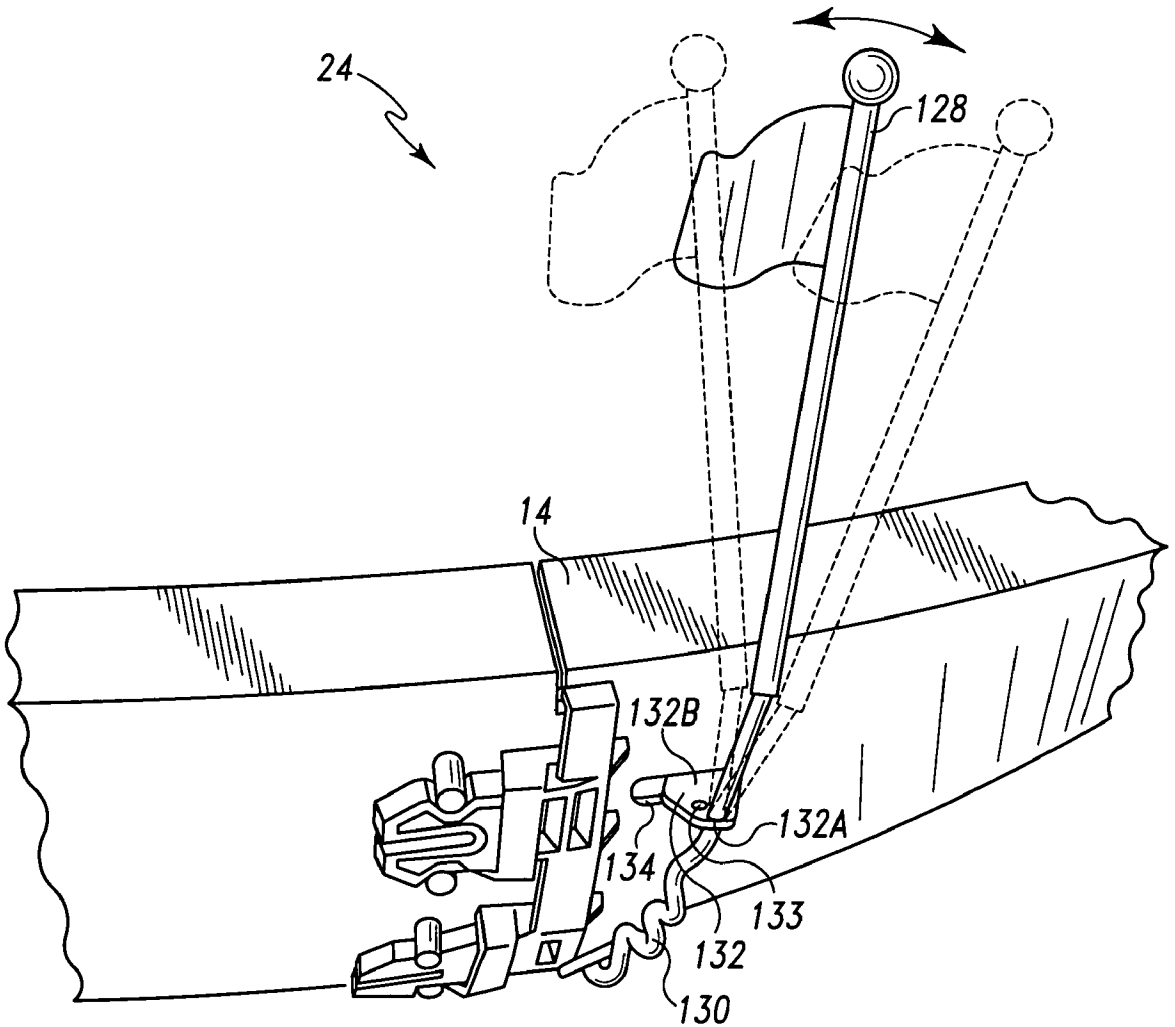
FIG. 7 is a rear view of a passive indicator mechanism that may optionally be included with the playset of FIG. 1.

Playset 10 may include passive indicator mechanism 24 for indicating when vehicle 12 passes by a specific location on track 14. For example, as shown in FIGS. 1 and 7, passive indicator mechanism 24 may be mounted to track 14 in a position near an outside edge of a banked section such that it will be triggered by vehicle 12 passing near the outside edge. However, passive indicator mechanism 24 could be placed in numerous other positions along track 14, such as an inside lane, near a finish line, or at regularly spaced intervals.

As shown most clearly in FIG. 7, passive indicator mechanism 24 may include a passive indicator flag 128, a spring member 130, and a lever arm. 132 pivotable about a fulcrum 133. Passive indicator flag 128 may be a rigid member shaped to resemble a flag and may generally extend above track 14. Spring member 130 may pass through an opening in an end 132A of lever arm 132 and couple to passive indicator flag 128 on a distal end and couple to track 14 on a proximal end. In some examples, a sleeve (not shown) may be attached to the distal end of spring member 130 with the shaft of passive indicator flag 128 supported loosely in the sleeve. Such an arrangement may allow passive indicator flag to rotate within the sleeve as spring member 130 moves.

Lever arm 132 may attach to track 14 at fulcrum 133 with an end 132*b* extending through a track aperture 134 formed in surface 26. Lever arm 132 may thus extend into a particular travel path 30 of vehicle 12. Vehicle 12 may contact lever arm 132 when it travels in the particular travel path 30 and impart motion to lever arm 132 about fulcrum 133 and to spring member 130. Motion of spring member 130 may in turn cause passive indicator flag 128 to wiggle or wobble in a fashion similar to a flag waving. In some examples, spring member 132 is a coiled spring and made from a resilient material. In this case, spring member 130 may move for a relatively long time after having motion imparted to it by fulcrum 130 until its motion dampens out.

Playset 10 may be played with in numerous ways. One method of use includes propelling vehicle 12 along track 14 with booster mechanism 16. A user may direct vehicle 12 into one of a plurality of travel paths 30 by pressing handle 64 of switching mechanism 18 to actuate chute 50 into a desired position.

Playset 10 provides numerous desired positions for chute 50 depending on a result a user may wish to obtain. For example, one such desired position may be a position that directs vehicle 12 into intermittently obstructed travel path 77, in which obstacle 76 may be deployed and cause vehicle 12 to collide with. Another desired position may be a position that directs vehicle 12 into unobstructed travel path 78 to avoid a potential collision with obstacle 76. Another example of a desired position would be a position that directs vehicle 12 towards a particular travel path 30 that lever arm 132 of passive indicator mechanism 24 extends into to cause passive indicator flag 128 to wiggle or wobble.

As vehicle 12 travels around playset 10 it may engage first trigger 86 of counter mechanism 84. When first trigger 86 is engaged a sufficient number of times as determined by the relative gearing size of counter mechanism 84, obstacle mechanism 22 may deploy or stow obstacle 76. In addition, obstacle indicator mechanism 120 may pivot into a warning position.

Numerous other methods of using playset 10 should be apparent to those skilled in the art from the structure described. For example, vehicle 12 may be placed on display platform 44 to observe vehicle 12 as vehicle 12 rotates. In addition, a user may press activator 70 to pivot indicator flag 68.

Another example of a playset 10 for use with a toy vehicle 12 comprises an elongate track 14 having a plurality of travel paths 30 in which toy vehicle 12 may travel, a switching mechanism 18 mounted to elongate track 14 for switching toy vehicle 12 between the plurality of travel paths 30, a trigger 86 extending into at least one of the plurality of travel paths 30, trigger 86 being configured to be engaged by toy vehicle 12 moving in the at least one travel path 30; and an obstacle mechanism 22 mounted to elongate track 14 with an obstacle 76 operatively connected to trigger 86, wherein obstacle 76 moves relative to at least one of the plurality of travel paths 30 when trigger 86 has been engaged a set number of times.

A further example of a playset 10 for use with a toy vehicle 12 comprises a track 14 having a surface 26 that provides a travel path 30 for toy vehicle 12, and an indicator mechanism 24 mounted to track 14, indicator mechanism 24 including a spring member 130, a rigid indicator 128 coupled to spring member 130, and a lever arm 132 mounted for pivoting relative to track 14 and having a first end 132A coupled to spring member 130.

Another example of a playset 10 for use with a toy vehicle 12 comprises a track 14 providing a travel path 30 for toy vehicle 12, and a first module mounted to track 14, the first module including a booster mechanism 16 in travel path 30 for accelerating toy vehicle 12 along travel path 30 in a given direction D, a switching mechanism 18 mounted along track 14 in given direction D from booster mechanism 16 and that is manually operable for selectively directing toy vehicle 12 to different portions of travel path 30; and a display platform 44 for rotating toy vehicle 12 when toy vehicle 12 is supported thereon, display platform 44 being mounted adjacent to travel path 30 and drivingly connected to booster mechanism 16.

While embodiments of a playset for use with a toy vehicle have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed.

Where "a" or "a first" element or the equivalent thereof is recited, such recitations include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

What is claimed is:

1. A playset for use with a toy vehicle comprising:

an elongate track haying a plurality of travel paths in which the toy vehicle may travel;

a user operable switching mechanism mounted to the elongate track for selectively directing the toy vehicle into one the plurality of travel paths, the mechanism including a pair of spaced-apart and substantially parallel sidewalls forming a chute therebetween through which the toy vehicle may be directed, the sidewalls including first ends between which the toy vehicle enters the chute and second ends between which the toy vehicle exits the chute, the sidewalls being configured to pivot about the first ends to thereby change the direction of the chute;

a trigger extending into at least one of the plurality of travel paths; the trigger being configured to be engaged by the toy vehicle moving in the at least one travel path; and an obstacle mechanism mounted to the elongate track with an obstacle operatively connected to the trigger, wherein the obstacle moves to obstruct at least one of the plurality of travel paths when the trigger has been engaged a set number of times.

2. The playset of claim 1, further comprising an indicator mechanism adjacent to the track, the indicator mechanism including:

a pivotally mounted indicator member, and an actuator configured to pivot the indicator member when actuated by a user.

3. The playset of claim 1, wherein the obstacle mechanism further comprises:

a gear train operatively connected to the trigger and configured to move in response to movement of the trigger;

a crankshaft operatively connected to the gear train and configured to move in response to movement of the gear train; and a lever arm coupled to the obstacle and in contact with the crankshaft, the lever arm configured to move the obstacle relative to at least one of the plurality of travel paths when moved by the crankshaft.

4. The playset of claim 1, wherein:

the gear train has a first gear ratio, the gear ratio being defined as the number of times the trigger must be engaged to move the obstacle; and wherein the obstacle mechanism further comprises a change gear configured for selective engagement with the gear train to change the first gear ratio to a second gear ratio that changes the number of times the trigger must be engaged to move the obstacle.

5. The playset of claim 1, wherein the obstacle mechanism further comprises:

a flag assembly pivotally mounted relative to the track; and a linking member linking the obstacle to the flag assembly to pivot the flag assembly when the obstacle moves.

6. The playset of claim 5, wherein the flag assembly further comprises:

a sleeve coupled to the linking member; and a flag loosely supported in the sleeve such that the flag rotates when the flag assembly pivots.

7. The playset of claim 1, wherein the obstacle mechanism further comprises a lock mechanism manually operable for retracting the trigger into a retracted position where a toy vehicle moving about the track will not engage the trigger.

8. The playset of claim 1, further comprising a booster mechanism for accelerating the toy vehicle along the travel path.

9. The playset of claim 8, further comprising a rotating platform mounted adjacent to the track and drivingly coupled to the booster mechanism for rotating a toy vehicle supported on the platform.

10. A playset for use with a toy vehicle comprising:

a track having a surface that provides a travel path for the toy vehicle, the track including an aperture; and an indicator mechanism mounted to the track, the indicator mechanism including:

a spring member;

a rigid indicator coupled to the spring member, and a lever arm mounted for pivoting relative to the track having a first end coupled to the spring member and a second end that extends through the aperture and past the surface of the track into a contact position where the toy vehicle traveling over the aperture contacts the second end of the lever arm and imparts motion to the indicator mechanism.

11. The playset of claim 10, wherein the aperture is located on the track in a position closer to an outside edge of the travel path than to an inside edge of the travel path.

12. The playset of claim 10, wherein the spring member includes a first end mounted to the track and a second end opposite the first end, the second end extending through the fulcrum and coupling with the rigid indicator.

13. A playset for use with a toy vehicle comprising:

a track providing a travel path for the toy vehicle; and first and second modules mounted to the track, wherein the first module includes:

a booster mechanism in the travel path for accelerating the toy vehicle along the travel path in a given direction;

a switching mechanism mounted along the track in the given direction from the booster mechanism and that is manually operable for selectively directing the toy vehicle to different portions of the travel path; and a display platform for rotating the toy vehicle when the toy vehicle is supported thereon, the display platform being mounted adjacent to the travel path and drivingly connected to the booster mechanism;

and wherein the second module includes:

a housing disposed adjacent to the track and enclosing a cavity; and an obstacle pivotally mounted to the housing and configured to pivot between a hidden position inside the cavity and an obstructing position outside of the cavity in at least a portion of the travel path.

14. The playset of claim 13, the second module further including a trigger that is positioned to be engaged by the toy vehicle traveling on the track and that is operatively coupled to the obstacle for triggering the obstacle to pivot between the hidden position and the obstructing position.

15. The playset of claim 13, wherein the switcher mechanism includes:

two spaced apart members, each member being pivotally attached at a pivot end of the member;

an actuator configured to pivot at least one of the members; and a cross member linking the members at positions spaced from the pivot ends to move the members in unison when the actuator moves at least one of the members.

16. The playset of claim 15, wherein each member has an upper edge with a lip extending over the track toward the other member, the lip restricting vertical movement of the toy vehicle.

17. The playset of claim 13, wherein the booster mechanism includes:

a motor;

gearing drivingly connected to the motor; and a pair of wheels spaced apart at opposite positions on the travel path, at least one wheel being drivingly connected to the gearing, the wheels rotating in opposite directions to accelerate the toy vehicle along the travel path when the toy vehicle travels between the wheels.

18. The playset of claim 17, wherein:

the display platform includes a display platform gear rotatably mounted to the first module, the display platform being supported on the display platform gear; and the gearing includes an extension shaft and an extension gear that drivingly connects the display platform gear with the gearing.

* * * * *

UNITED STATES PATENT AND TRADEMARK OFFICE

CERTIFICATE OF CORRECTION

PATENT NO. : 7,637,796 B2
APPLICATION NO. : 11/594018
DATED : December 29, 2009
INVENTOR(S) : Keith Hippely It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 533 days.

Signed and Sealed this

Ninth Day of November, 2010

David J. Kappos

David J. Kappos
*Director of the United States Patent and Trademark Office*